US007753065B1

(12) United States Patent
Bevins et al.

(10) Patent No.: US 7,753,065 B1
(45) Date of Patent: Jul. 13, 2010

(54) HYDRANT BACKFLOW RESTRICTION SYSTEM

(75) Inventors: Michael J. Bevins, Riverton, UT (US); Bradley S. Gilson, Draper, UT (US)

(73) Assignee: TAP Security, LC, Draper, UT (US)

( * ) Notice: Subject to any disclaimer, the term of this patent is extended or adjusted under 35 U.S.C. 154(b) by 483 days.

(21) Appl. No.: 11/800,961

(22) Filed: May 7, 2007

Related U.S. Application Data

(60) Provisional application No. 60/836,602, filed on Aug. 8, 2006.

(51) Int. Cl.
*E03C 1/10* (2006.01)
*F17K 15/18* (2006.01)

(52) U.S. Cl. ..... 137/1; 137/15.02; 137/272; 137/301; 251/359

(58) Field of Classification Search ..... 137/272, 137/300, 301, 614.2, 888, 895, 299, 1, 15.01, 137/15.02; 251/359, 360, 361
See application file for complete search history.

(56) References Cited

U.S. PATENT DOCUMENTS

| | | | | |
|---|---|---|---|---|
| 726,369 | A * | 4/1903 | Sullivan | 137/272 |
| 4,475,570 | A | 10/1984 | Pike et al. | |
| 4,602,654 | A | 7/1986 | Stehling et al. | |
| 5,029,603 | A | 7/1991 | Ackroyd | |
| 5,129,416 | A | 7/1992 | Ackroyd | |
| 5,246,028 | A * | 9/1993 | Vandepas | 137/282 |
| 6,488,048 | B2 | 12/2002 | Kuhmayer et al. | |
| 6,868,860 | B2 | 3/2005 | Davidson | |
| 7,055,544 | B2 | 6/2006 | Davidson | |
| 7,128,091 | B2 | 10/2006 | Istre, Jr. | |
| 7,174,911 | B2 | 2/2007 | Davidson | |
| 7,240,688 | B2 | 7/2007 | Davidson, Sr. et al. | |
| 2004/0123992 | A1 | 7/2004 | Davidson | |
| 2004/0154659 | A1 | 8/2004 | Lafalce | |
| 2006/0201551 | A1 | 9/2006 | Davidson et al. | |

OTHER PUBLICATIONS

Davidson Hydrant Technologies and Homeland Security Products and Services, LLC, www.defendyourh2o.com/about_us/about_us.html, Sep. 12, 2007, 2 pages.
Metro Spirit, Bin Laden's next target?, http://metrospirit.com/index.php?cat=121110107430726 5&ShowArticle_ID=1101220507, Sep. 12, 2007, 7 pages.

* cited by examiner

*Primary Examiner*—Kevin L Lee
(74) *Attorney, Agent, or Firm*—Thorpe North & Western LLP

(57) ABSTRACT

A hydrant backflow prevention system comprises a backflow prevention valve, operably coupleable to a hydrant to restrict passage of materials through the hydrant into a water supply feeding the hydrant. The backflow prevention valve is installable fluidly inline with the water supply at a location below which an upper dry barrel of the hydrant is coupled to a water delivery system. The backflow restriction valve is operable to substantially restrict backflow into the water supply when in a closed position, and allow flow of water through the hydrant when in the open position.

24 Claims, 9 Drawing Sheets

HYDRANT BACKFLOW RESTRICTION SYSTEM

The present application claims the benefit of U.S. Provisional Patent Application Ser. No. 60/836,602, filed Aug. 8, 2006, which is hereby incorporated herein by reference in its entirety.

FIELD OF THE INVENTION

The present invention relates generally to systems for use with hydrants in preventing backflow of materials through the hydrants to a water supply.

BACKGROUND OF THE INVENTION

Conventional fire hydrants have been used for many years as a way in which firefighters can access the water supply of a municipality for use in fighting fires. While such hydrants perform well for their intended use, it has been appreciated of late that the many hydrants connected to a particular water supply could serve as a location at which a person or persons intent on contaminating the water supply could gain access to the water supply.

For example, it is contemplated that, should a person or persons with ill intent wish to introduce into a water supply a contaminant, such as a poisonous, hazardous, or otherwise unsafe material, such a person could do so by way of one of the many hydrants connected to such a water supply. Even if no persons were struck seriously ill, or killed, by the presence of the contaminant in the water supply, once the contaminant was introduced into the water supply, significant time and energy would be required to purge the water supply of the contaminant. In some cases, if a contaminant such as radioactive material were introduced into the water supply, the entire water delivery system (e.g., pipes, pumps, treatment facilities, etc.) may have to be replaced before safe drinking water could be supplied to the municipality.

Systems for preventing just such an event have been proposed, and generally consist of installing a "back pressure" valve in the upper dry barrel of the hydrant to limit or prevent any material from flowing through the hydrant into the water supply. While such systems have been proven at least partially efficacious, they have, to date, included components that are installed within the upper barrel of the hydrant itself. As such, these systems themselves are susceptible to tampering and can be relatively easily rendered ineffective by a person or persons intent on contaminating the water supply by way of a hydrant in which such systems have been installed. In addition, many of these systems are designed for use with new hydrant installations, and are not readily adaptable for retrofitting of existing hydrants.

SUMMARY OF THE INVENTION

It has been recognized that it would be advantageous to develop a backflow restriction system that will prevent unwanted introduction of foreign materials into a water supply via a hydrant connected to the water supply.

The present invention provides a hydrant backflow prevention system, including a backflow prevention valve operably coupleable to a hydrant to restrict passage of materials through the hydrant into a water supply feeding the hydrant. The backflow prevention valve can be installable fluidly inline with the water supply at a location upstream of an upper dry barrel of the hydrant. Further, the backflow restriction valve can be operable to substantially restrict backflow into the water supply when in a closed position, and allow flow of water through the hydrant when in the open position.

In accordance with another embodiment of the invention, a hydrant backflow prevention system can comprise a backflow prevention valve operably coupleable to a hydrant to restrict passage of materials through the hydrant into a water supply feeding the hydrant. The valve can include a venturi housing including a seat formed or attached therein; and a riser positioned on the seat in a closed configuration, and which is operable to be suspended away from the seat in response to positive fluid flow through the hydrant. The riser can be suspended away from the seat at a distance sufficient to maintain the riser substantially away from turbulent flow of the water as water flows positively through the venturi housing and around the riser.

In accordance with another embodiment of the invention, a method of protecting a water supply from introduction of contaminants into the water supply through a hydrant is provided, including: removing an upper dry barrel of a hydrant; installing a backflow prevention valve fluidly inline with a water supply feeding the hydrant at a location below the upper dry barrel; and reinstalling or replacing the upper barrel of the hydrant. The backflow prevention valve can be operable to: substantially restrict backflow into the water supply when in a closed position, and allow flow of water through the hydrant when in the open position.

There has thus been outlined certain features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION OF THE PREFERRED EMBODIMENT(S)

Figure 1:
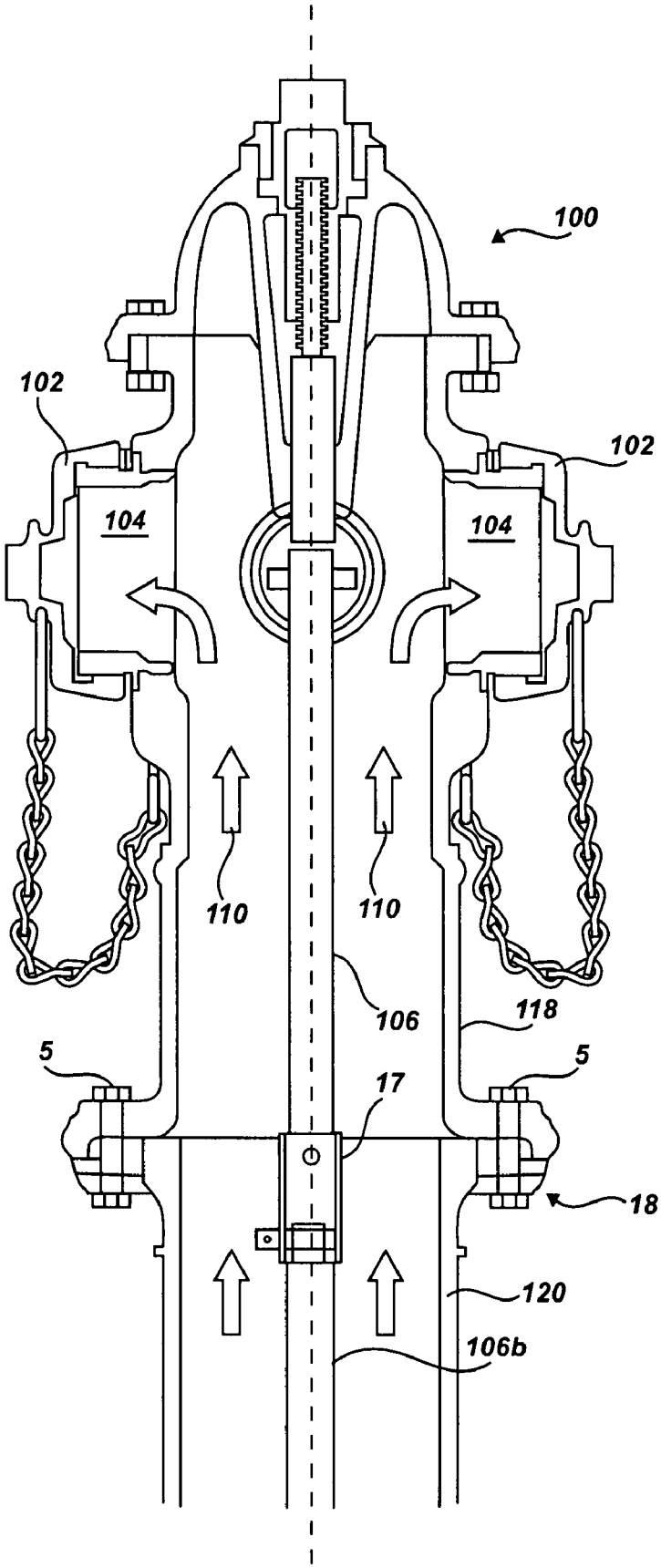
Fig. 1 PRIOR ART
FIG. 1 is a sectional view of a conventional, prior art hydrant with which the present invention can be incorporated.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting. In describing and claiming the present invention, the following terminology will be used in accordance with the definitions set forth below.

It is noted that, as used in this specification and the appended claims, the singular forms "a" and "the" include plural referents, unless the context clearly dictates otherwise. Thus, for example, reference to an "upright arm" includes one or more of such arms.

As used herein, the term "downstream" is to be understood to refer to a direction of fluid flow from a water supply toward (or through) a hydrant. Similarly, as used herein, the term "upstream" is to be understood to refer to a direction of fluid flow from (or through) a hydrant toward a water supply. The term "positive" fluid flow is to be understood to refer to fluid flow in a downstream direction (e.g., in the direction in which a hydrant system is designed to normally operate).

As used herein, relative terms are used to refer to various components of hydrants, such as "upper," "lower," "upwardly," "downwardly," etc. It is to be understood that such terms in no way limit the present invention but are used to aid in describing the components of the hydrants, and water delivery systems generally, in the most straightforward manner. When such terms are used, it is to be understood that they are in reference to the generally accepted orientation of hydrants when installed or positioned for use. In such an orientation, the hydrant is generally vertical and coupled to a piping system that extends into the ground in a generally vertical orientation.

As used herein, the term "substantially" refers to the complete or nearly complete extent or degree of an action, characteristic, property, state, structure, item, or result. For example, when an object or group of objects is/are referred to as being "substantially" liquid-tight, it is to be understood that the object or objects are either completely liquid-tight or are nearly completely liquid tight. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

When referring to "restriction" or "prevention" with respect to backflow in accordance with embodiments of the present invention, it is understood that complete prevention or restriction is not required to be considered as providing "backflow prevention" or "backflow restriction." Complete backflow prevention or restriction may be a desirable goal, but in practice, is difficult to achieve, though both complete and substantially complete backflow prevention or restriction are included in the context of the present invention.

When referring to a "venturi housing," it is understood that this specific type of shape is described for convenience, as other shapes can also be used, e.g., bell shapes or other flow shapes suitable for a needle and seat valve, or other, similar flow valve.

The term "upper barrel" or "upper dry barrel" refers to the fluid conduit barrel that is at least substantially within the above-ground portion of the fire hydrant assembly. Most fire hydrant assemblies include an upper barrel and a lower barrel, where the lower barrel is usually substantially below ground level. The upper barrel is usually coupled to the lower barrel by a device such that the two barrels can be separated from one another.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 6 inches" should be interpreted to include not only the explicitly recited values of about 1 inch to about 6 inches, but also include individual values and sub-ranges within the indicated range. This same principle applies to ranges reciting only one numerical value and should apply regardless of the breadth of the range or the characteristics being described.

FIG. 1 illustrates a conventional, prior art hydrant 100 of the type commonly referred to as "center stem" hydrants. While the discussion herein will focus on center stem hydrants of the type shown in FIG. 1, it is to be understood that the inventive concepts discussed below are readily adaptable for use with other types of hydrants. The conventional center stem hydrant 100 generally includes an upper, "dry" barrel 118 which is coupled to a lower hydrant barrel 120, a majority of which typically resides below ground level. Generally, only an uppermost portion of the lower barrel 120 is exposed above ground level, to provide access to mounting bolts 5 which couple the upper barrel to the lower barrel.

One or more valve covers 102 cover each of one or more hose coupler ports 104. When a user (e.g., firefighter) wishes to utilize the hydrant as a source of water, one or both the valve covers are removed from the hose coupler ports and one or more hoses (not shown) is/are attached to the hose coupler ports. Once the hoses are attached, the user can turn the hydrant stem 106 causing a foot valve (not shown) disposed below (and upstream) of the upper barrel 118 to open, which results in water flowing around or past the foot valve, through the hydrant and out the hose coupler ports. Typically, the foot valve is disposed at a 90 degree bend where the bottommost portion of the hydrant piping is joined to the generally horizontal pipes carrying water from the water source (not shown). For a reasonable discussion of the operation of a typical foot valve utilized with such hydrants, review of U.S. Patent Publication No. 2004/0123992, which is hereby incorporated herein by reference to the extent it is consistent with the teachings herein, is useful.

In general, the upper barrel 118 is "dry" (e.g., it typically contains little or no water) until the foot valve is opened, at which point the barrel is essentially filled with water flowing (or tending to flow) in the direction shown by directional indicators 110. When the foot valve is closed (by turning the hydrant stem 106 in an opposite direction), the water that remains in the upper barrel 118 is no longer pressurized and drains from within the lower barrel 120 and upper barrel 118 by way of a weep hole drain valve (not shown), which can be installed adjacent the foot valve. This drained water is generally allowed to seep into the ground adjacent the hydrant, and is not, typically, reintroduced into the water source.

Some hydrants include a "breakaway" stem coupler 17 and "breakaway" mounting flange 18 that are designed to break if the hydrant is subjected to a significant force, such as if the hydrant is struck by a vehicle. The breakaway coupler and flange ensure that, should the upper barrel 118 be sheared from the lower barrel 120, the portion of the stem 106*b* below the breakaway coupler will remain intact, ensuring that the foot valve (not shown), to which the lower portion of the stem is attached, is not broken open. In this manner, the hydrant can be destroyed by being contacted by a vehicle without resulting in a "geyser" of water being released by the collision.

Figure 2:
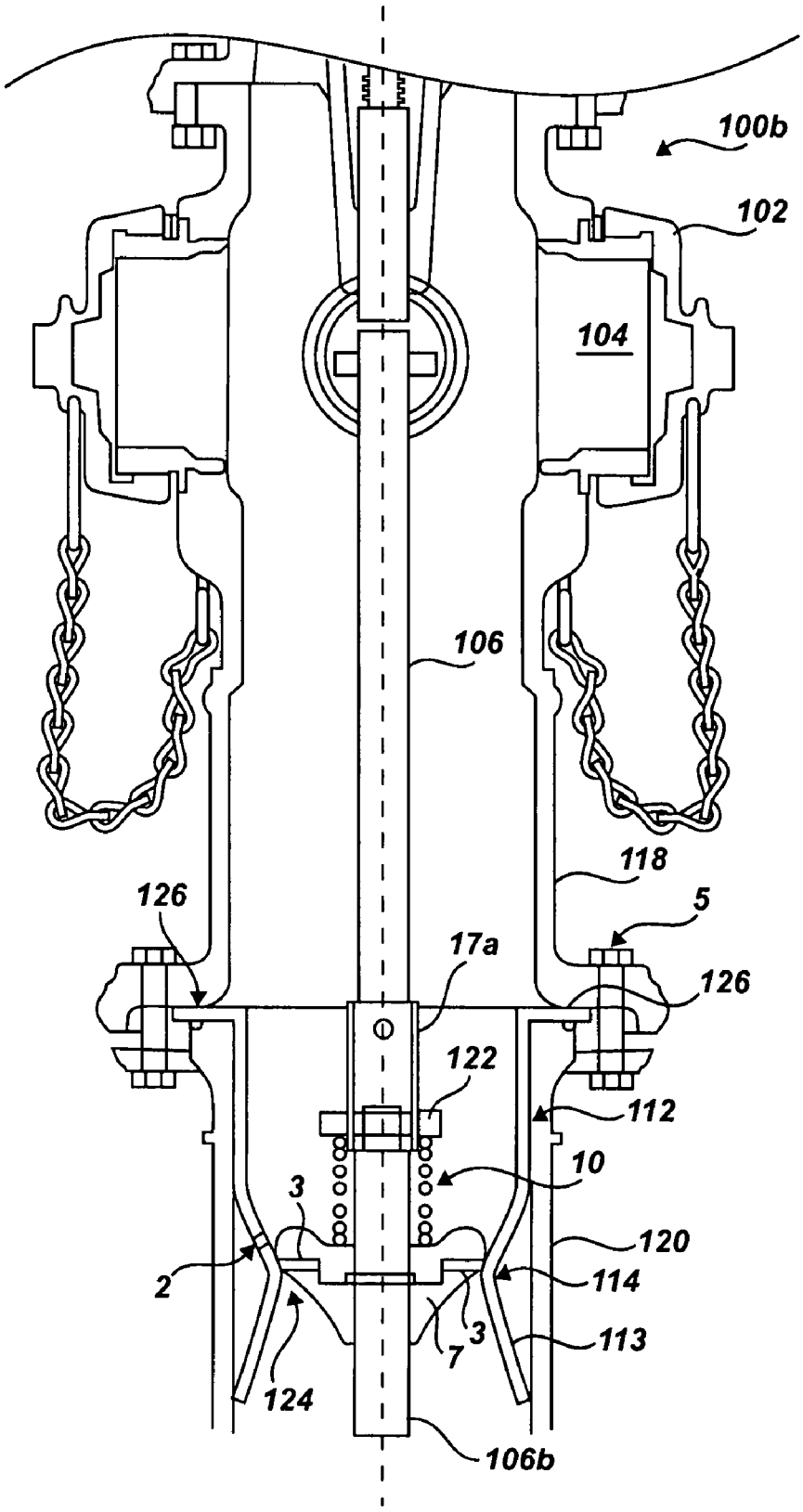
FIG. 2 is a sectional view of the hydrant of FIG. 1, with a backflow prevention valve in accordance with the present invention incorporated therein.

Turning now to FIG. 2, a hydrant 100*b* operationally similar to the hydrant of FIG. 1 is illustrated, with a backflow prevention valve 112 installed below (e.g., "upstream") of the upper hydrant barrel 118. The backflow prevention valve operates to prevent and/or restrict the introduction of materials past the backflow prevention valve and potentially upstream into the water source (not shown) to which the hydrant is connected. The valve can be installed within the hydrant by fitting an upper flange 126 between the upper hydrant barrel and the lower hydrant barrel 120. The backflow prevention valve generally includes a venturi housing 113 and a riser 7 that seats against an innermost portion 114 (e.g., "seat") of the venturi housing. Though the venturi housing and the riser are shown in a particular shape, it is noted that these structures can be of a variety of shapes that provide for acceptable fluid dynamics when in the "open" position, and acceptable prevention or restriction of forced upstream fluid flow when in the "closed" position.

The riser 7 shown fits about the stem 106*b* in an encircling relationship, similar to a collar. A breakaway coupler 17*a* can couple the upper portion 106 of the hydrant stem to the lower portion 106*b* of the hydrant stem, and can serve to fix an upper collar 122 relative to the stem 106. Thus, as the stem moves upwardly and downwardly within the hydrant [as the stem is rotated to open or close the foot valve (not shown), the stem moves upwardly or downwardly within the hydrant], the upper collar 122 also moves upwardly and downwardly within the hydrant.

A biasing element (e.g., spring) 10 can intercouple the riser 7 and the upper collar 122 and can allow movement of the upper collar and the riser relative to one another. For example, when the riser is in a closed position (e.g., seated against the innermost portion or seat 114 of the venturi housing 113), the hydrant stem can be moved in a downward direction, which will compress the spring while maintaining the riser seated against the innermost portion or seat of the venturi housing (until water pressure unseats the riser). While the embodiments shown in the figures are generally coupled to the stem via a spring, it is to be understood that some embodiments of the invention do not utilize a spring and instead rely simply on the mass of the riser (and the force of gravity) seating the riser in the absence of a pressurized flow of water upward through the hydrant.

When the stem 106, 106*b* has moved sufficiently downward to cause the foot valve (not shown) to open (and thereby release flow of water from the water source (not shown)), the pressure of the positive flow of water from the water source will generally be sufficiently high to elevate the riser 7 from its seated position and allow flow of water from upstream toward the riser. As the riser is forced upward by the pressurized flow of water, the spring will continue to compress and store kinetic energy therein. Once the pressurized flow of water has been stopped (e.g., the foot valve has been closed), the energy stored in the spring can cause the riser to seat once again against the innermost portion or seat 114 of the venturi housing 113 to prevent backflow of materials upstream past or around the riser.

Figure 3:
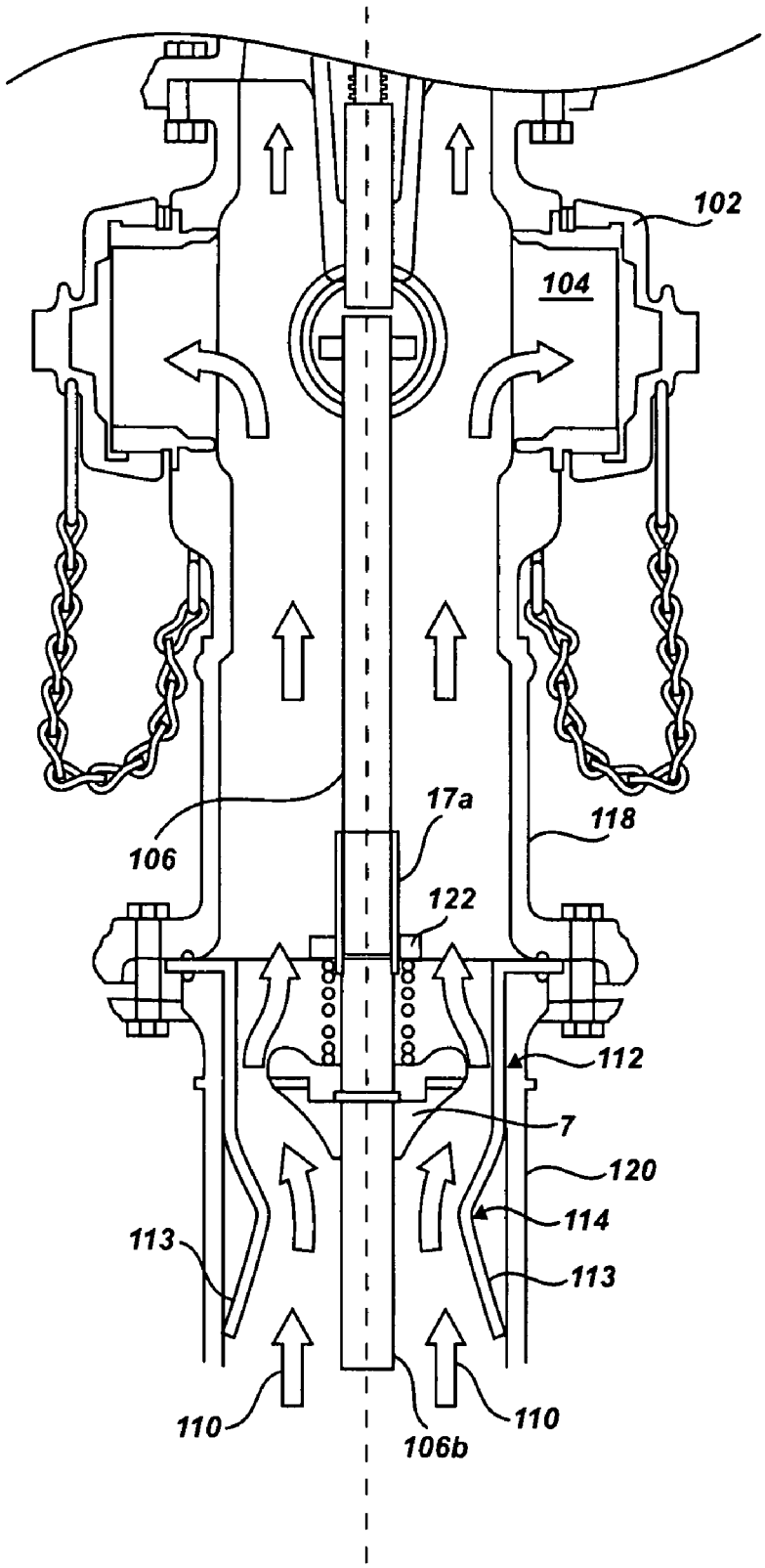
FIG. 3 is a sectional view of the hydrant of FIG. 2, with the backflow prevention valve shown in an open position.
Figure 4:
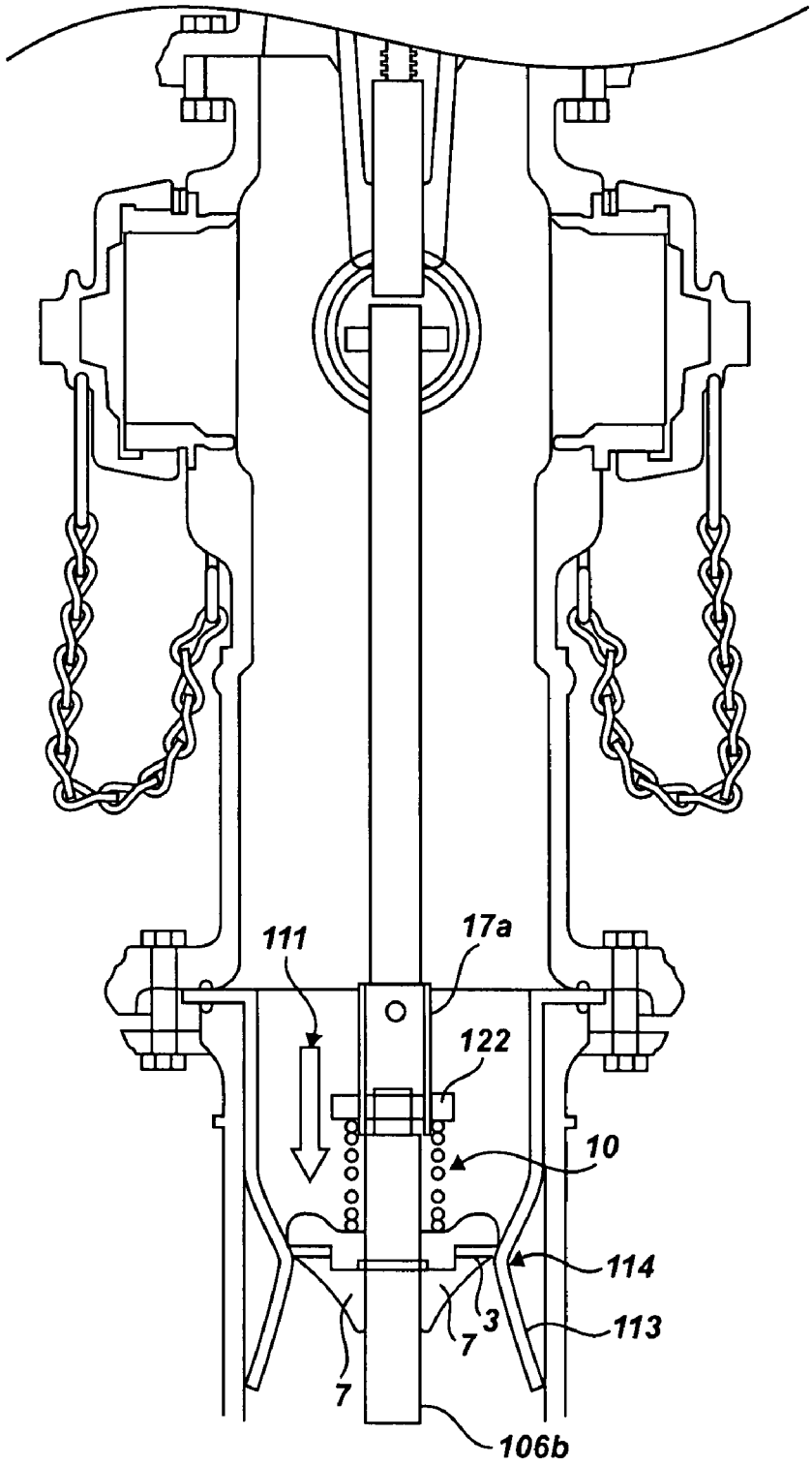
FIG. 4 is a sectional view of the hydrant of FIG. 2, with the backflow prevention valve shown in a closed position.

This series of events is further illustrated in FIGS. 3 and 4. In FIG. 3, the riser 7 is shown an open position, with water flowing from upstream past the riser, as shown by directional indicators 110. It is notable that that the scale of the drawings does not clearly indicate that the collar 122, in some embodiments, can actually be closer to the riser 7 when the riser is in the open position (e.g. FIG. 3), than when in the closed position (e.g., FIGS. 2 and 4), and can actually be positioned lower relative to the innermost portion 114 of the venturi housing 113 when in the open position than when in the closed position. This is due to the fact that, in most systems, the stem sections 106, 106*b* (and thus the collar 122) actually move downward when opening the foot valve (not shown) to allow flow of water through the hydrant.

Thus, though the specific embodiment shown in FIG. 3 includes a design in which the foot valve (not shown) is opened by raising the stem (as evidenced by the fact that the breakaway coupler 17*a* is shown as being brought above the lower barrel 120 and into the upper barrel 118), in many cases, such as in Mueller fire hydrant assemblies, the opposite is true (i.e. the stem is lowered to open the foot valve downwardly). In a system where the foot valve is opened by downward movement of the stem, the spacing between the upper collar 122 and the riser can be adjusted to accommodate the relationship between the downward movement of the upper collar and the opening of the riser upwardly in response to upstream water pressure, e.g., lengthened. Without regard to the manner in which the foot valve is opened (e.g., by downward or upward movement of the stem and foot valve) the same principles apply. Specifically, by opening the foot valve, upstream water pressure causes the riser to be lifted from the innermost portion or seat of the venturi housing, allowing flow of fluid from upstream into, through and past the upper barrel.

The riser 7 is shown again in a closed position in FIG. 4, by which it will be appreciated that any pressurized fluid (gas or liquid) tending to flow in direction 111 will be blocked by the seated riser (assuming that little or no pressure exists on the upstream side of the riser—e.g., below the innermost section or seat 114).

Figure 5:
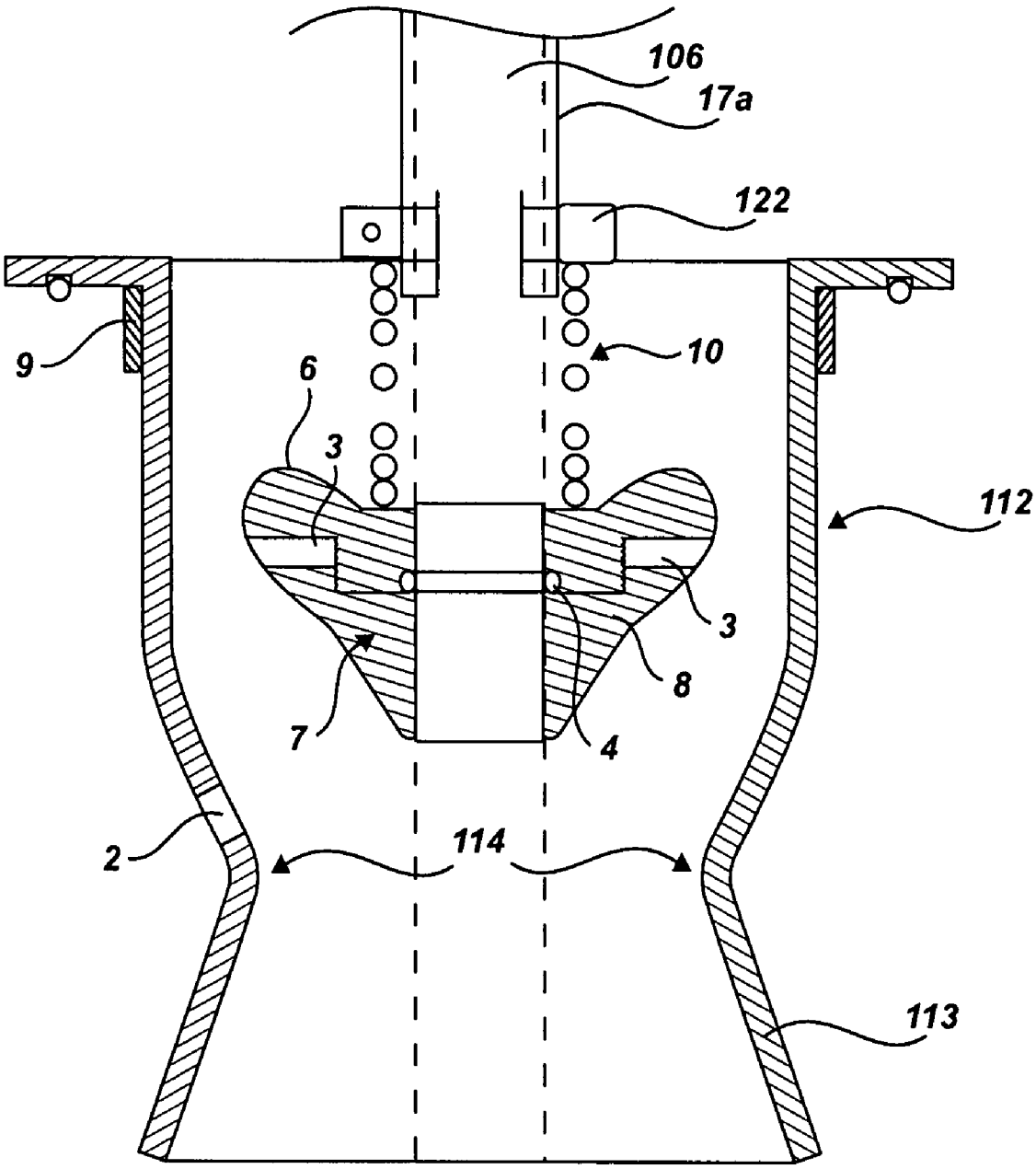
FIG. 5 is a sectional view of some components of a backflow prevention valve in accordance with an embodiment of the invention.

FIG. 5 includes a simplified view of several components of the backflow prevention valve 112. In this embodiment, the riser 7 is formed of at least two components, a cap portion 6 and a base portion 8. The cap portion and base can be coupled to one another via a threaded interface. A gasket 3 can be clamped between the cap portion and the base portion to aid in seating the riser against the innermost portion or seat 114 of the venturi housing 113. The two-piece construction of the riser can be advantageous in that it allows secure installation of the gasket, and provides for relatively easy replacement of the gasket.

Also shown in FIG. 5 is an optional positioning shoulder 9, which allows contouring of venturi body in the rough cast of the lower barrel. Additionally, a bleed valve 2 is shown which can be a pressure free valve that allows fluid in the upper barrel to drain when the riser is closed, but when the riser is open and water is flowing, can be closed due to the pressure of the water flow. An O-ring 4 is also shown on the riser, which can prevent pressure flow from the riser to the stem. The riser of the valve can also include a stem collar that is positioned over the stem when the valve is in place.

The riser can be formed from a variety of a materials, including metal, rubber, plastic, ceramic, or the like. The riser can optionally be coated, e.g., dip coated, spin coated, etc., with a rubber or other pliable material that will allow the riser to become substantially sealed against the venturi housing when in the closed position. Other embodiments are also possible, as would be apparent to one skilled in the art after considering the present disclosure.

Figure 6:
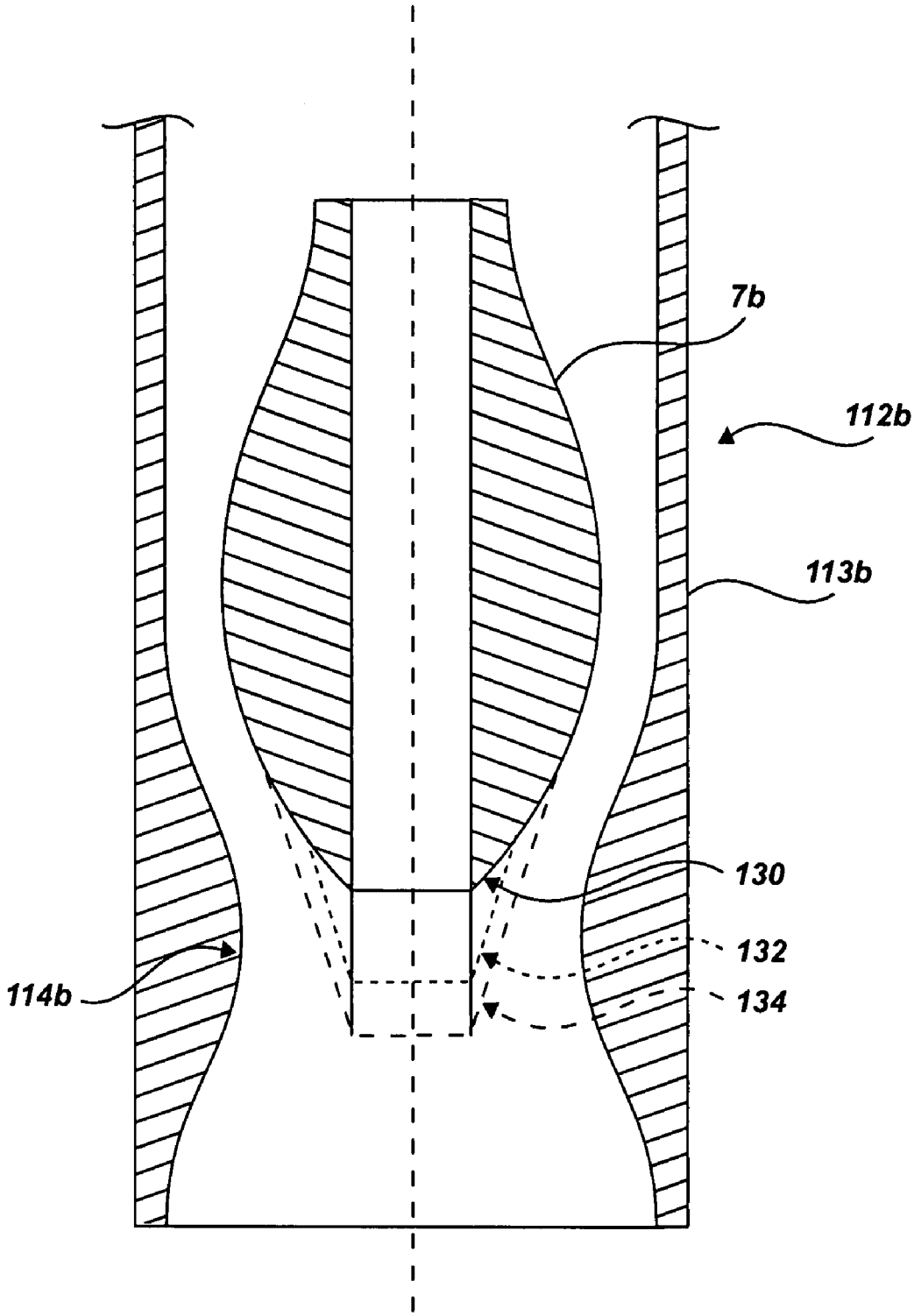
FIG. 6 is a partial, sectional view of a backflow prevention valve in accordance with another embodiment of the invention.
Figure 8:
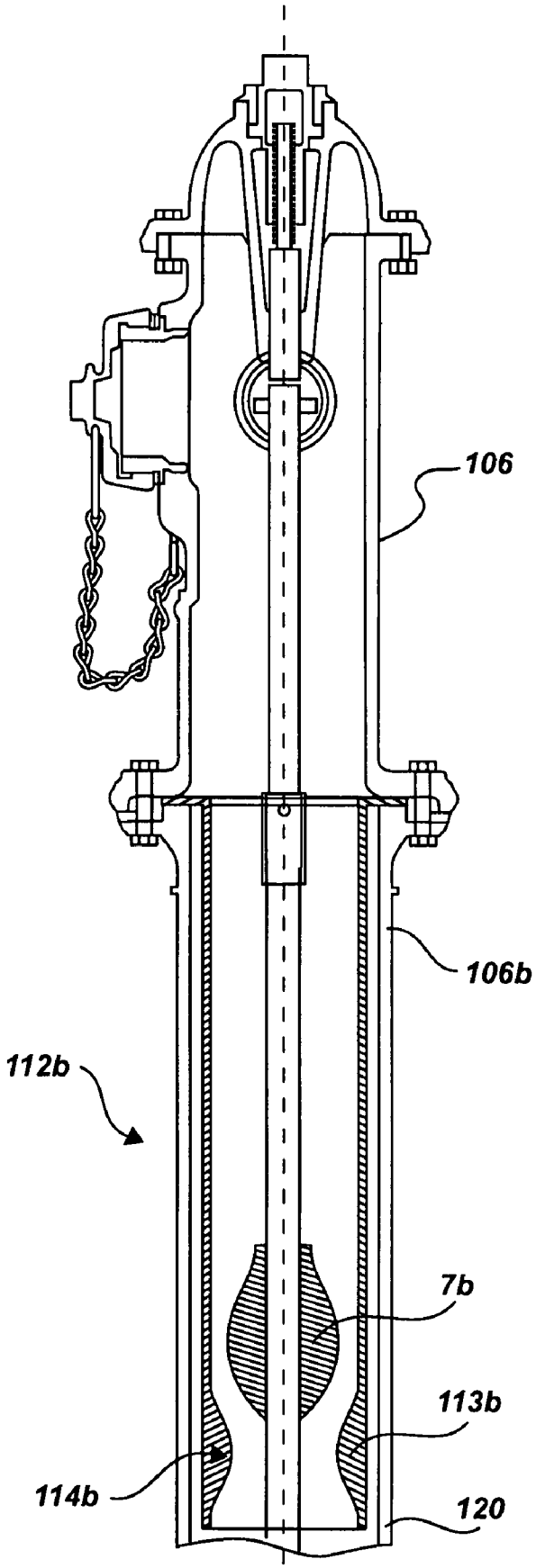
FIG. 8 is a sectional view of the backflow prevention valve of FIG. 7, shown installed in a conventional hydrant system.

Turning now to FIG. 6, another backflow prevention valve 112*b* is provided in accordance with an embodiment of the invention. The valve can include riser 7*b* and corresponding venturi housing 113*b*. In this figure, the stem on which the riser 7*b* would travel, and the breakaway coupler that might be used to connect the riser to the stem 106, are both omitted for clarity. It is to be understood, however, that the riser 7*b* would likely fit about the stem, and that the venturi housing would be coupled within the hydrant, in much the same manner described in the embodiments above. This coupling between the venturi housing and the fire hydrant assembly would typically be within the lower barrel of the fire hydrant (as shown in FIGS. 2 and 8).

The riser 7*b* of this embodiment can be formed in the general shape of an ellipsoid, with three of many possible lower curvatures shown at 130, 132 and 134. The interior, mating portions or seats 114*b* of the venturi housing 113*b* can correspond to the generally elliptical shape of the riser 7*b*. The shape of the riser has been found advantageous in a number of manners. For example, the generally elliptical shape aids in reducing or attenuating "hammer" effects experienced by other shapes of risers. It is believed that, as water flows upward from the foot valve (not shown) of a conventional hydrant, it tends to form vortices or turbulence within the lower hydrant barrel (120 in FIGS. 2 and 8) that can cause the riser to rapidly bounce upwardly and downwardly within the housing and impede the flow of water through the housing. As the amount of "head loss" allowed for most types of hydrants is generally quite small, this hammer effect can reduce the performance (e.g., flow rate) of the backflow prevention valve to an unacceptable level. In other words, the head loss introduced into the overall system by the backflow prevention valve can be unacceptably high.

By forming the riser 7*b* in the shape shown and described, it is believed that the riser is better able to "ride" within the center of the vortices formed in the housing 113*b* and not be subject to cyclical, upward-and-downward movement within the housing. The elliptical shape shown and described also aids in providing a riser and seat assembly that mate sufficiently well to restrict backflow through the valve (when the valve is in a closed configuration), and yet are sufficiently streamlined to produce a relatively low addition to the overall head loss of the hydrant (when the valve is in an open configuration).

Figure 7:
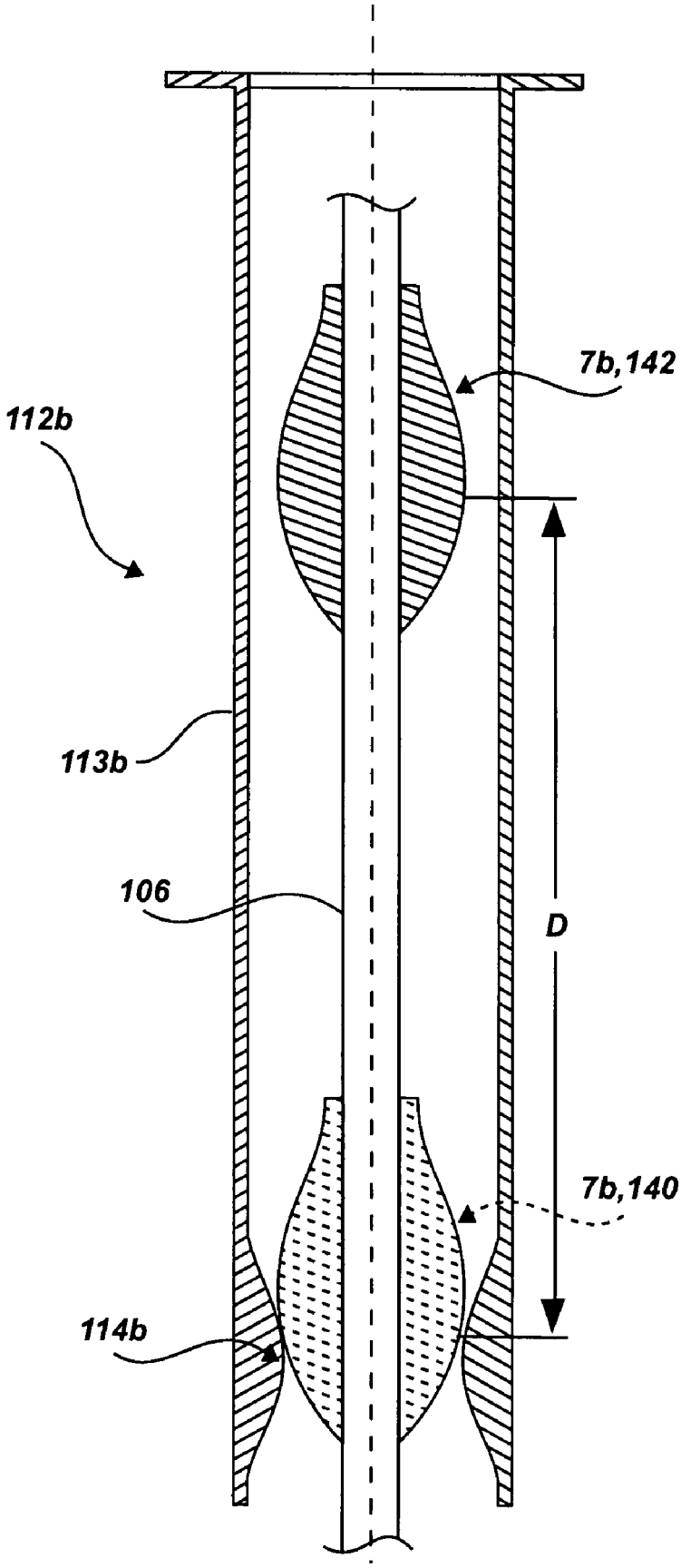
FIG. 7 is a sectional view of the backflow prevention valve of FIG. 6, shown with the riser in both a closed and an extended, open position.

FIG. 7 illustrates the backflow prevention valve 112*b* and the venturi housing 113*b* in broader detail. It is noted that the dimensions of the venturi housing and the riser 7*b* are not necessarily to scale. The riser is shown at position 140 in a closed configuration and at 142 in an open position. As will be appreciated, the distance "D" is a measure of the amount of separation existing between the position of the riser when in a closed position and the position of the riser when in an open position. As discussed above, it is believed that, as water flows downstream through the hydrant (in an upward direction in FIG. 7) and past or around the innermost section 114*b* of the housing 113*b*, turbulence or vortices can be formed within or near the innermost section of the housing. Whether or not this turbulence is formed due to the flow of fluid through the foot valve (not shown), or through the innermost section of the venturi housing, it is believed that positioning the riser within this generally non-laminar flow of fluid can cause significant head loss within the hydrant.

To address this concern, the present system includes riser 7*b*, which, when in the open position shown at 142, is spaced a sufficient distance from the innermost portion 114*b* of the housing such that fluid flow around the riser is much less turbulent (or not at all turbulent) and, accordingly, the backflow prevention valve 112*b* in the open configuration adds minimally to the overall head loss of the hydrant. The distance "D" can vary from one embodiment to another, but is generally in the range of about 1 inch to about 36 inches, or in other embodiments, from 6 inches to 36 inches, or from 12 inches to 36 inches.

In one aspect of the invention, it has been found that a sufficient separation distance D can be obtained when installing the valve 112*b* within a lower hydrant barrel (120 in FIGS. 2 and 8) of as little as about three feet in length. Lower barrel sections are currently available to installers in lengths of from 18 inches to 5 feet, in 6 inch increments (e.g., 18 inches, 2 feet, 2½ feet, 3 feet, etc.). In one exemplary, but non-limiting, embodiment, the backflow prevention valve is formed within a 3 foot length, resulting in a valve that can be retrofitted into greater than about 90% of the lower, dry barrels that are used in conjunction with Mueller and other center stem hydrants currently installed throughout the country.

FIG. 8 illustrates one exemplary installation in accordance with the current embodiment, with the backflow prevention valve 112*b* of FIG. 7 shown installed in a conduit or pipe 120 of a conventional water delivery system.

The present invention has been found to effectively prevent or restrict contamination of water supply systems through hydrants while not significantly increasing the overall head loss through the hydrant. While particular embodiments can produce varying results, in one aspect of the invention the head loss introduced by the backflow prevention valve of the present invention is less than about 4 psi at 750 gpm. In another embodiment, the head loss introduced by the backflow prevention valve is less than about 3 psi at about 750 gpm. In another aspect, the head loss is between about 0.5 psi and 3 psi at about 750 gpm.

Figure 9:
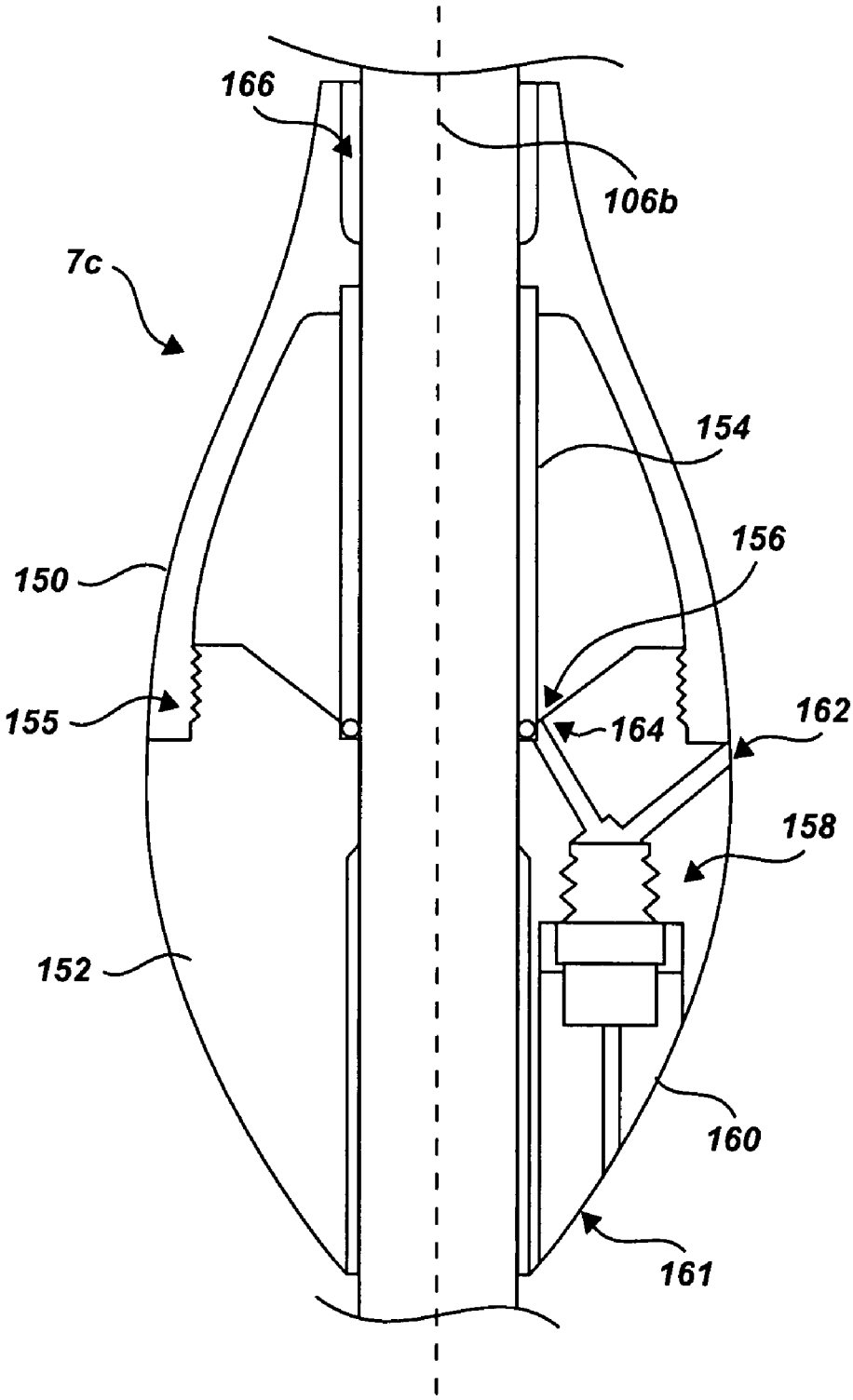
FIG. 9 is a sectional view of a riser of a backflow prevention valve in accordance with an embodiment of the invention (with a portion of a shaft on which the riser rides shown therewith).

FIG. 9 illustrates an exemplary riser 7*c* in accordance with another aspect of the invention. In this embodiment, the riser can include an upper casing 150 and a lower casing 152. A seal retaining collar 154 can aid in securing a seal (e.g., O-ring) 156 within the riser to enable the riser to slide along the stem 106*b* with minimal frictional interference. The upper and lower casings can be threadably coupleable to one another to allow separation for maintenance and/or installation and/or manufacturing purposes (as shown, for example, by threaded mating connectors 155).

The lower casing 152 can include freeze drain valve 158 and a freeze drain valve seal or plug 160. The freeze drain valve seal can aid in creating a smooth surface 161 that substantially matches the contour of the riser 7*c* in adjacent areas to aid in minimizing turbulent flow of water (and/or cavitation) due to the presence of the freeze drain valve. Weep holes 162, 164 can allow drainage of water from "above" the riser into the lower barrel (not shown in FIG. 9), which can itself contain a weep drain (not shown), as discussed above. The freeze drain can be operable to drain water from above the riser in the absence of any significant pressure from the upstream direction. In other words, the freeze drain prevents or restricts flow upstream if any significant pressure exists on the upper side of the riser (as would be the case, for example, if a person were attempting to force contaminants beyond the riser and into the water supply). However, in the absence of any significant pressure, the freeze drain can allow water to drain into the lower hydrant barrel (120 in FIG. 8).

A spring housing 166 can be included in the upper casing 150 to receive, retain or otherwise associate the riser 7*c* with a biasing element (e.g., 10 in FIG. 2) to aid in returning the riser to the sealed or seated position that occurs when the valve is in the closed configuration.

The upper 150 and lower 152 casings can be formed from the same or different materials. In one embodiment, the lower casing can be formed from an acid-resistant material, which can be, for example, a relatively hard plastic material. The upper casing can be formed from naval brass (which can be beneficial for its fire-resistant properties).

The above-described invention provides numerous advantages over convention hydrant backflow devices. For example, the present backflow prevention valve can be included with new hydrant installations, and can be easily installed when retrofitting existing hydrants. In addition, the components of the present system can be installed without detracting from the "breakaway" designs of conventional hydrant stems. Also, as the present system is installed some feet below the exposed, operable portions of the hydrant (e.g., the hose coupler ports 104 shown in FIG. 2), the present backflow prevention valves are substantially completely "tamper proof" as they can't be accessed without dismantling the entire hydrant.

In addition to the valve described above, the present invention is also drawn to fire hydrants that include the valve incorporated therein. In other words, though the valve described above relates primarily to a retrofitting device, it is understood that the valve can also be manufactured integrally with the lower barrel, or as a modular assembly piece for initial installation with new fire hydrants.

Further, it should be noted that the present invention is also drawn to various related methods, including methods of installing such valves. This method can include: placing a backflow restriction system in the lower barrel of a fire hydrant assembly, and attaching an upper barrel to the lower barrel. In one embodiment, the connection between the upper and lower barrel can be used to secure the backflow restriction valve within the hydrant, as shown in the figures. If the method involves retrofitting an existing fire hydrant, then the preliminary step of removing the upper barrel can be carried out prior to the other steps. Other methods are also contemplated, including methods of preventing backflow in a fire hydrant, which includes positioning a backflow prevention valve in a lower barrel of a fire hydrant assembly. Each of these methods can also benefit from the structural embodiments described throughout the present specification.

As a further note, it is understood that the valve described herein can be positioned completely within the lower barrel, or can be positioned within the lower barrel and, in part, within the upper barrel. Both embodiments are within the scope of the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A hydrant backflow prevention system, comprising:

a backflow prevention valve operably coupleable to a hydrant to restrict passage of materials through the hydrant into a water supply feeding the hydrant, the backflow prevention valve being installable fluidly inline with the water supply at a location upstream of an upper dry barrel of the hydrant, the backflow restriction valve being operable to:

i) substantially restrict backflow into the water supply when in a closed position, and ii) allow flow of water through the hydrant when in the open position, wherein the backflow prevention valve includes:

a venturi housing including a seat formed or attached therein; and a riser positioned on the seat in a closed configuration, and being operable to be suspended away from the seat in response to positive fluid flow through the hydrant.

2. The system of claim 1, wherein the location is at or below ground level.

3. The system of claim 1, wherein the backflow prevention valve allows flow of water through the hydrant while adding a backflow valve head loss of less than about 3 psi at 750 gpm.

4. The system of claim 3, wherein the backflow valve head loss is between about 0.5 psi and about 3 psi.

5. The system of claim 3, wherein the backflow valve head loss is less than about 0.5 psi.

6. The system of claim 1, wherein the riser is operable to be suspended away from the seat a distance sufficient to maintain the riser substantially away from non-laminar flow of the water as the water flows positively through the venturi housing and around the riser.

7. The system of claim 1, wherein the riser is configured to substantially seal against the seat when water is not flowing through the hydrant.

8. The system of claim 1, wherein the venturi housing is installable within an existing conduit of the water delivery system.

9. A hydrant backflow prevention system, comprising a backflow prevention valve, operably coupleable to a hydrant to restrict passage of materials through the hydrant into a water supply feeding the hydrant, the backflow prevention valve, including:

i) a venturi housing including a seat formed or attached therein; and ii) a riser positioned on the seat and operable to be suspended away from the seat in response to positive fluid flow through the hydrant, said riser being suspended away from the seat at a distance sufficient to maintain the riser substantially away from turbulent flow of the water as water flows positively through the venturi housing and around the riser.

10. The system of claim 9, wherein the backflow prevention valve is installable at a location below an upper dry barrel of the hydrant.

11. The system of claim 10, wherein the location is at or below ground level.

12. The system of claim 9, wherein the backflow prevention valve allows flow of water through the hydrant while adding to an overall head loss of the hydrant a backflow valve head loss of less than about 3 psi at 750 gpm.

13. The system of claim 12, wherein the backflow valve head loss is between about 0.5 psi to about 3 psi.

14. The system of claim 12, wherein the backflow valve head loss is less than about 0.5 psi.

15. The system of claim 9, wherein the riser is configured to substantially seal against the seat when water is not flowing through the hydrant.

16. The system of 9, wherein the venturi housing is installable within an existing conduit of the water delivery system.

17. A method of protecting a water supply from introduction of contaminants into the water supply through a hydrant, comprising:

a) removing an upper dry barrel of a hydrant;

b) installing a backflow prevention valve fluidly inline with a water supply feeding the hydrant at a location below the upper dry barrel, the backflow prevention valve being operable to:

i) substantially restrict backflow into the water supply when in a closed position, and ii) allow flow of water through the hydrant when in the open position; and c) reinstalling or replacing the upper barrel of the hydrant, wherein the backflow prevention valve includes:

a venturi housing including a seat formed or attached therein; and a riser positioned on the seat in a closed configuration, and being operable to be suspended away from the seat in response to positive fluid flow through the hydrant.

18. The method of claim 17, wherein the location is at or below ground level.

19. The method of claim 17, wherein the backflow prevention valve allows flow of water through the hydrant while adding to an overall head loss of the hydrant a backflow valve head loss of less than about 3 psi at 750 gpm.

20. The method of claim 19, wherein the backflow valve head loss is between about 0.5 psi to about 3 psi.

21. The method of claim 19, wherein the backflow valve head loss is less than about 0.5 psi.

22. The method of claim 17, wherein the riser is operable to be suspended away from the seat a distance sufficient to maintain the riser substantially away from non-laminar flow of the water as the water flows positively through the venturi housing and around the riser.

23. The method of claim 17, wherein the riser is configured to substantially seal against the seat when water is not flowing through the hydrant.

24. The method of claim 17, wherein the venturi housing is installable within an existing conduit of the water delivery system.

* * * * *